US012516584B2

(12) United States Patent
Laun

(10) Patent No.: US 12,516,584 B2
(45) Date of Patent: Jan. 6, 2026

(54) CEMENT PLUG AND METHODS OF USE

(71) Applicant: Canadian Casing Accessories Inc., Calgary (CA)

(72) Inventor: Lyle Laun, Calgary (CA)

(73) Assignee: Canadian Casing Accessories INC., Calgary (CA)

( * ) Notice: Subject to any disclaimer, the term of this patent is extended or adjusted under 35 U.S.C. 154(b) by 0 days.

(21) Appl. No.: 18/733,928

(22) Filed: Jun. 5, 2024

(65) Prior Publication Data

US 2024/0410248 A1 Dec. 12, 2024

Related U.S. Application Data

(60) Provisional application No. 63/506,489, filed on Jun. 6, 2023.

(51) Int. Cl.
*E21B 33/12* (2006.01)

(52) U.S. Cl.
CPC ..... *E21B 33/1208* (2013.01); *E21B 33/1204* (2013.01)

(58) Field of Classification Search
CPC ..... E21B 33/16; E21B 33/165; E21B 33/167
See application file for complete search history.

(56) References Cited

U.S. PATENT DOCUMENTS

| | | | | |
|---|---|---|---|---|
| 2,717,645 | A * | 9/1955 | Schnitter | E21B 33/16 166/156 |
| 6,561,270 | B1 * | 5/2003 | Budde | E21B 33/167 166/153 |
| 2016/0362963 | A1 * | 12/2016 | Leiper | E21B 17/10 |
| 2018/0313186 | A1 * | 11/2018 | Zhang | E21B 33/13 |

* cited by examiner

*Primary Examiner* — David Carroll
(74) *Attorney, Agent, or Firm* — FisherBroyles, LLP; Russell Manning

(57) ABSTRACT

An improved cement plug and methods of use for wiping the inner surface of a casing string positioned within a subterranean wellbore are provided, the plug having at least one annular wiper fin having at least one gap therethrough, the gap forming at least one wiper fin segment.

20 Claims, 7 Drawing Sheets

CEMENT PLUG AND METHODS OF USE

CROSS-REFERENCE TO RELATED APPLICATION

This application claims benefit of priority to U.S. Provisional Patent Application No. 63/506,489 entitled "IMPROVED CEMENT PLUG AND METHODS OF USE" and filed Jun. 6, 2023, which is specifically incorporated by reference herein for all that it discloses or teaches.

FIELD

Embodiments herein are generally related to improved apparatus for use in the oil and gas industry and, more particularly, to downhole plugs such as cement plugs.

BACKGROUND

During the drilling of a wellbore into a subterranean hydrocarbon formation, it is desirable to stabilize the wellbore by introducing multiple layers of steel pipe or 'casing' of varying diameters downhole, the outermost to innermost layers of casing known as conductor casing, surface casing, intermediate casing, and production casing, respectively.

Casing can be joined end-to-end and run downhole as 'casing string' to different depths depending on its function. Depending on various parameters, production casing strings may be installed to span the entire length of the wellbore from the surface casing to the production zone at or near the toe. In such cases, referred to in the industry as "long strings", the same drilling bottom hole assembly (BHA) used to drill the production interval of the wellbore is also used to drill through the intermediate or surface shoe track. As a result, the size of the open hole in the production zone ends up being roughly the same size as the drill bit, which can be substantially smaller than the size of the surface casing. For example, without limitation, a common production casing size may be 4½" and is installed in open hole sizes ranging from 6.125"-6.75", whereas a common surface casing size may be 9⅝"×36 lb/ft casing (having an inner diameter of approximately 8.921").

As is well known, casing string must be cemented in place in order to stabilize the wellbore. Cementing procedures involve pumping a cement slurry through the inside and out from the bottom of each casing until it circulates up into the annulus, forming a cement sheath around the casing. Once in the annular space, the cement slurry sets to form an annular sheath of hardened, substantially impermeable cement that bonds and stabilizes the casing string to the wellbore.

Prior to introducing the cement slurry into the casing, however, the casing may contain drilling mud or other servicing fluids that could contaminate the cement slurry. To prevent contamination of the drilling mud with the cement slurry, one or more cement plugs can be introduced into the casing string prior to the cement slurry in order to form a barrier between the drilling mud and the slurry. Moreover, once the cement slurry has been pumped through the casing and into the annular space between the casing and wellbore, displacement fluids are used to clean residual cement from the casing. To prevent contamination of displacement fluids with the cement slurry, one or more cementing plugs can be introduced into the casing to isolate the cement from the displacement fluids (i.e., with a pressure differential of less than 10 psi being required to displace the plug through the casing). form a barrier, preventing comingling of fluids.

Once the plug has landed on the landing collar, it can be "bumped" to conclude the cementing operations (i.e., with a pressure differential of up to approximately 1500 psi being required to observe the increase in pump pressure indicating that the plug has landed in the landing collar). Cement plugs can then be drilled from the casing string to reinstate fluid through therethrough.

Conventional cement displacement plugs (CDPs) are typically manufactured from drillable material, such as nitrile rubber, Viton rubber, or polyurethane rubber, and often have an outer diameter of approximately 9.15" (e.g., when used in conventional 9⅝" casing). Conventional CDPs can form at least five wiper fins, each fin thickness ranging from approximately 0.4" to 0.8". As a result, problems arise when a smaller drill bit used for casing "long strings" (e.g., a 6.125" diameter drill bit) is used to drill conventional CDPs from the casing, including the creation of multiple, thick, strong annular remnant rings that can interfere with fluid circulation and cuttings transport during the milling operation. More specifically, the residual annular rings are known to become lodged (hung-up on) the mud motor, a BHA connection, and/or the drill string. In addition, because the rings can end up being circulated up the drill string and casing annulus, the rings cannot flow to the mud tanks along with drill cutting when they arrive at surface.

Moreover, although the large 9.15" outer diameter of conventional CDPs is compatible across a wide range of casing weights having varying inner diameters, the rubber molds used to design and manufacture known CDPs are large, costly, and time consuming. A one-sized outer diameter CDP can also be too large relative to the inner diameter of certain casing string (particularly those having varied inner diameters), causing the CDP to be difficult to install into the surface equipment (cement head) and causing excessive friction and wear to the plug as it travels through the string.

There is a need for an improved segmented cement plug that can be readily milled from the casing string without the creation of annular rings and mill debris. It is desirable that such an improved cement plug be easy to install at surface equipment, cement head, or floor launcher. It is also desirable that such an improved cement plug rotationally lock into the float collar and be operable to hold "bump" test pressures once landed in the shoe track.

SUMMARY

[NTD—to be Completed when Claims are Finalized]

According to embodiments, a cement plug and method of use for wiping the inner surface of a casing string positioned within a subterranean wellbore are provided, the plug comprising a tubular body having a first end and a second end and a substantially cylindrical sidewall forming a longitudinal bore, at least one annular wiper fin extending axially from the body, the at least one wiper fin extending radially from the body and forming at least one gap through the wiper fin, wherein the at least one gap defines at least one wiper fin segment. In some embodiments, the at least one gap of the at least one annular wiper fin may extend from the plug body to an outer surface of the at least one wiper fin.

In some embodiments, the plug may comprise at least two annular wiper fins, and the at least two wiper fins may form an annular space therebetween. In some embodiments, the tubular plug body may further comprise a plurality of longitudinally extending apertures allowing fluid flow from the longitudinal bore of the body to the at least one annular space.

In some embodiments, at least one of the at least two wiper fins may comprise a unitary annular fin. In some embodiments, at least one of the at least two wiper fins may comprise a plurality of interlocking fin segments. In some embodiments, at least one of the at least two wiper fins may be substantially hollow, forming channels therein.

In some embodiments, the plug may further comprise at least one cap positioned at the first end of the body, securely received within the longitudinal central bore and preventing fluid flow therethrough. In some embodiments, the at least one cap positioned may be configured for sealingly landing and locking the at least one plug within equipment positioned within the casing string. In some embodiments, the plug may further comprise at least one second cap positioned at the second end of the body, securely received within the longitudinal central bore and preventing fluid flow therethrough.

According to embodiments, methods of wiping an inner surface of a casing string positioned within a subterranean wellbore are provided, the method comprising providing at least one cement plug having a first end and a second end, and at least one annular wiper fin disposed about a sidewall of the at least one plug and extending radially outwardly therefrom to the inner surface of the casing string, the at least one annular fin having at least one gap forming at least one fin segment, launching the at least one cement plug into the casing string, introducing fluids into the casing string to hydraulically pump the at least one plug through the casing string, and allowing the at least one segmented annular wiper fin to frictionally engage with and wipe the inner surface of the casing string as the at least one plug travels through the casing string.

In some embodiments, the at least one plug may have at least two annular fins forming an annular space therebetween, and the method may further comprise securing the at least one plug within the casing string by positioning the at least one plug within the casing string, introducing cement into the casing string, and allowing the cement to pass through the plug into the annular space, torsionally anchoring the at least one plug in the casing string.

In some embodiments, the positioning of the at least one plug may comprise landing and rotationally locking the at least one plug in equipment positioned within the casing string. In some embodiments, once landed within the casing string, the method may further comprise performing a pressure test of the casing string.

In some embodiments, the method may further comprise providing drilling equipment into the casing string, and drilling the at least one plug from the casing string to reinstate fluid flow therethrough. In some embodiments, the drilling equipment may comprise an undersized drill bit.

In some embodiments, the at least one annular wiper fin may comprise a plurality of interlocking fin segments. In some embodiments, during the drilling of the at least one plug, the plurality of interlocking fin segments may controllably disconnect from one another to form fragments having a predetermined size and shape. In some embodiments, the method may further comprise circulating the at least one plug from the casing string.

BRIEF DESCRIPTION OF THE DRAWINGS

Various objects, features, and advantages of the present technology will be apparent from the following description of particular embodiments thereof, as illustrated in the accompanying drawings. The drawings are not necessarily to scale, emphasis instead being placed upon illustrating the principles of various embodiments of the technology. Similar reference numerals indicate similar components.

DETAILED DESCRIPTION OF THE PREFERRED EMBODIMENTS

Figure 1:
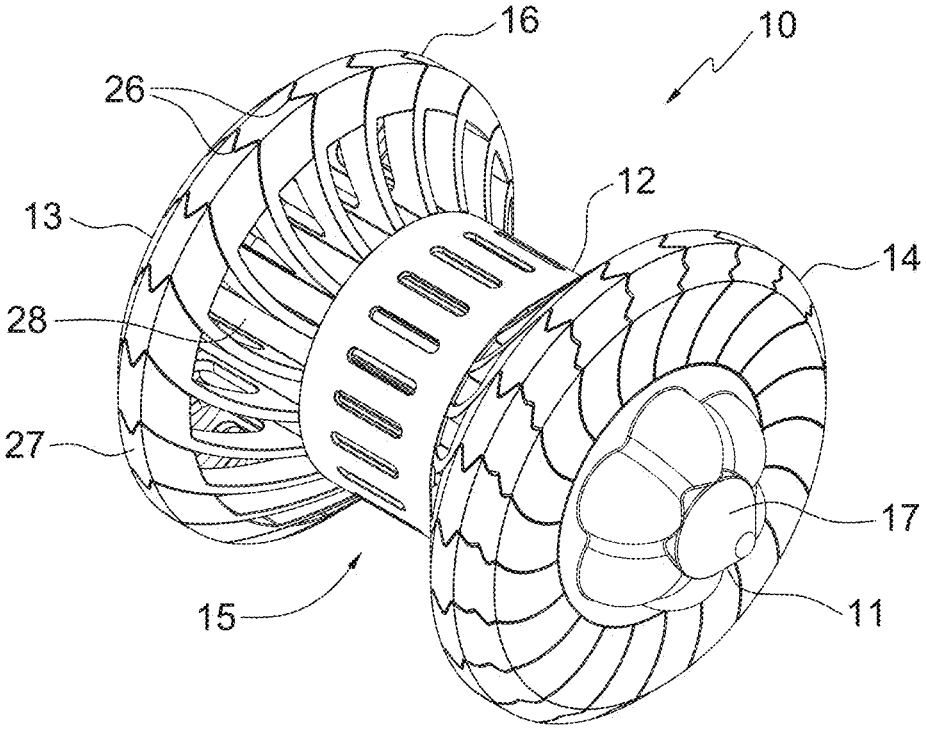
FIG. 1 shows a perspective view of an improved segmented cement plug, according to embodiments.

According to embodiments, the presently improved apparatus and methods of use provide an improved cement plug designed to be effectively milled from the casing string without the creation of annular rings. In some embodiments, the presently improved cement plug may form a body specifically designed to break apart into segmented elements during milling, enabling a smaller mill to be used effectively and efficiently. Without limitation, the presently improved cement plug, or cement displacement plug, may be specifically configured to break into segments having a predetermined size and shape, such size and shape enabling the segments to be readily circulated from the casing string. Moreover, as will be described, the presently improved plug may further be specifically configured such that a smaller diameter drill bit may be used to mill the plug from the casing string (e.g., bit may be smaller than the drift diameter of the casing string), eliminating the need for multiple 'trips' of drilling equipment downhole.

In some embodiments, the presently improved apparatus and methods of use may comprise providing a cement displacement plug or 'CDP' having at least one annular unitary fin forming 'gaps' therein and configured to break apart at or near the gaps into segmented components. In some embodiments, the presently improved apparatus and methods of use may comprise at least annular fin formed from a plurality of independent fin segments operably interconnected one to the other and forming 'gaps' therebetween and configured to break apart into segmented components, without forming annular rings during milling.

In some embodiments, the at least one annular fin(s) may be configured to provide a partially sealed engagement with the internal surface of the casing, ensuring the improved plug operates as a conventional wiper plug while, counter-intuitively, being configured to allow fluid flow 'leaks' from the wellbore above the plug to the wellbore therebelow (as further defined herein). That is, in some embodiments, the presently improved cement plug may otherwise serve as a conventional CDP, configured to controllably land and lock in place within downhole equipment, while also being configured to prevent atmospheric chambers from forming between the at least one fin(s) and to readily break apart without the creation of annular rings during milling.

In some embodiments, the at least one annular plug fin(s) may be configured to optimize the overall outer diameter of the plug relative to the inner diameter of the casing string, ensuring adequate wiping of the casing string. Without limitation, in some embodiments, the at least one annular fin may be configured to provide a specified volume of space that can become reduced when the presently improved plug is compressed for installation into the casing string, i.e., when a 'light-squeeze' is imposed upon the plug during installation into the surface equipment. For example, in some embodiments, the at least one annular wiper fin may be manufactured so as to be substantially hollow internally, enabling a controlled 'collapse' of the fin during compression. Depending upon the size of the casing string, the size, shape, and overall configuration of the apertures may be optimized, e.g., such as for use in mono bore applications, effectively minimizing the friction, drag, and wear on the plug (e.g., on the plug fin(s)).

In some embodiments, the at least one annular plug fins) may also be configured to optimize to maintain contact pressure between the improved plug and the inner surface of the casing string, while managing pressure differentials imparted on the plug as it travels through the string. Without limitation, in some embodiments, the at least one annular plug fin(s) may be perforated, forming at least one gap through the fin(s) (i.e., from uphole of the fin through to downhole of the fin), and creating a specific tortious fluid flow path, enabling a controlled tortious collapse of the at least one fin(s). In this manner, depending upon the size of the casing string, the size, shape, and overall geometry of the perforations, the fin(s) may be optimized to control the volume of fluid flow therethrough, ensuring plug undergoes a constant or near-constant squeeze from the casing string, regardless of the size of string. The size, shape, and overall geometry of the gaps may also be optimized to ensure the at least one annular fin(s) provides sufficient mechanical strength to withstand fluid pressure differentials imposed on the plug as it travels through the casing string, while preventing air at atmospheric pressure from becoming trapped therein (i.e., between the fin segments).

In some embodiments, the presently improved cement plug is further configured to provide at least one single sealing element for securely engaging, and rotationally locking into, downhole equipment positioned within the casing string, such as the float collar. Advantageously, the presently improved CDP may be configured such that the sealing element is positioned so as to be protected from wear and tear before the plug arrives at the float collar, ensuring the plug is operative to hold bump pressure. For example, as will be described, the at least one sealing element may comprise at least one end cap positioned at a downhole end of the presently improved plug.

Herein, the following terms are used for explanatory purposes and are not intended to limit or alter the actual componentry or implementation of the present apparatus and methods of use. The terms "above/below" and "upper/lower" are used for ease of understanding and are generally intended to mean the relative uphole and downhole from surface. The term "uphole" is intended to mean along the drill string or the wellbore from the distal end towards the surface and the term "downhole" is intended to mean along the drill string or wellbore from the surface towards the distal end.

Herein, the term "upstream" is intended to mean along a flow path towards the source of flow, and the term "downstream" is intended to mean along a flow path away from the source of the flow.

Herein, the terms "milling", "milling debris", "debris", and "cuttings" are intended to be used synonymously to describe the materials resulting from the milling of center portion of the presently described cement plug (i.e., whereby gaps(s) 26 are uniquely sized and radially positioned to intersect the outer diameter of the drill bit), but may also include other wellbore debris and cuttings.

In some embodiments, the presently improved plug may be designed to be launched or deployed downhole into a casing string (not shown) before, during, or after casing operations with the downhole nose end leading relative to a downhole direction of movement of plug through the casing.

The presently improved cement plug(s) will now be described having regard to FIGS. 1-7.

According to embodiments, having regard to FIG. 1, an improved cement plug 10 is provided. Improved cement plug 10 may comprise a tubular body 12 having a first downhole or 'nose' end 11, a second uphole or 'tail' end 13, and a substantially cylindrical sidewall forming longitudinally extending central housing bore 19 (FIG. 3).

In some embodiments, plug 10 may comprise at least one annular wiper fin extending radially from the body 12 (such that fin engages and wipes the inner surface of the casing string). In some embodiments, plug 10 may comprise at least two annular wiper fins, i.e., at least one first downhole annular wiper fin 14 and at least one second uphole wiper fin 16. In some embodiments, the first downhole wiper fin 14 may be positioned at or near the first 'nose' end 11 of body 12, and the second wiper fin 16 may be positioned at or near the second 'tail' end 13 of body 12. In some embodiments, annular fins 14,16 may be disposed about the cement plug 10 so as to form an annular space 15 therebetween (i.e., said space 15 extending axially about outer sidewall of body 12).

Figure 2:
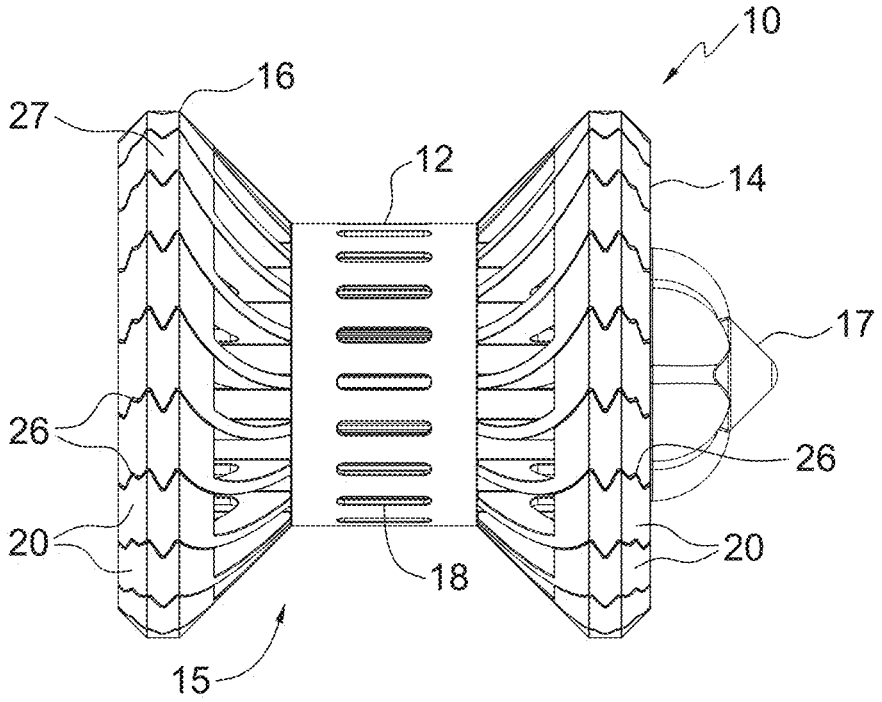
FIG. 2 shows a side view of the cement plug shown in FIG. 1, according to embodiments.
Figure 3:
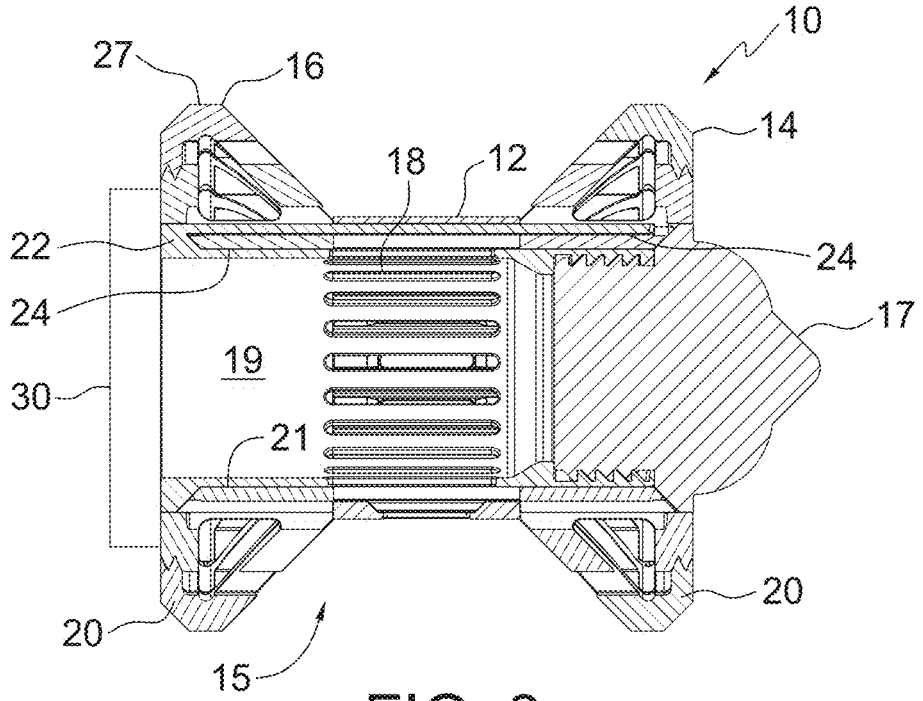
FIG. 3 shows a cross-sectional side view of the cement plug shown in FIG. 1, according to embodiments.
Figure 4:
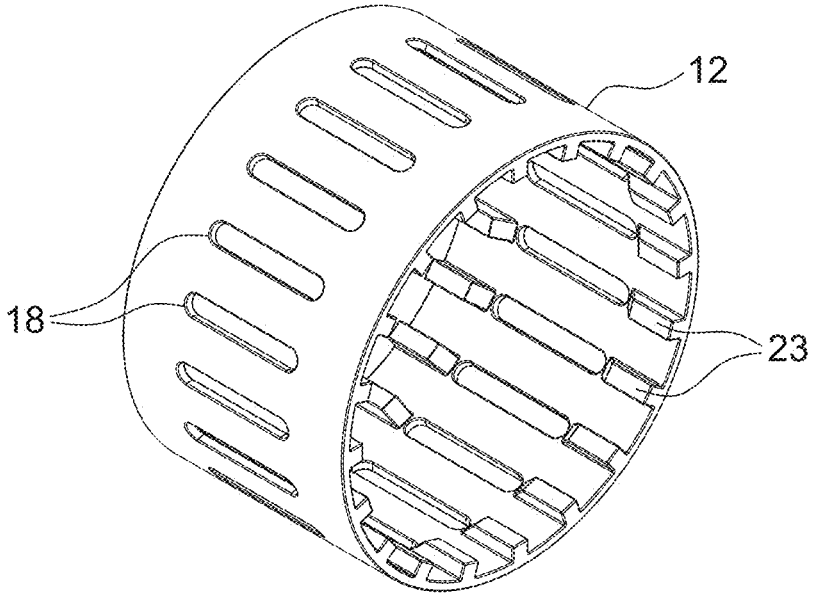
FIG. 4 shows a perspective side view of the body sidewall of the cement plug shown in FIG. 1, the sidewall shown in isolation, according to embodiments.

In some embodiments, having regard to FIGS. 2 and 3, plug 10 may form a plurality of longitudinally extending apertures 18 through the sidewall of plug body 12, enabling fluid flow from central bore 19 inside plug 10 to annular space 15 outside of plug 10 (and vice versa).

As will be described, apertures 18 may provide fluid communication between the wellbore uphole of plug 10 and annular space 15, enabling annular space 15 to be filled with cement and/or other fluids pumped downhole, as desired. For example, an operator desiring to provide torsional anchoring of plug 10 within the casing string, securing plug 10 in place for drilling, may introduce cement and/or cementing fluids into the wellbore above plug 10, where such fluids may enter bore 19 and pass through apertures 18 into annular space 15. In such embodiments, fluids may remain within annular space 15 and serve to bond the outer sidewall of body 12 to the casing string. Alternatively, in some embodiments, plug 10 may also be configured to allow cement to flow uphole into plug 10 from the casing therebelow (i.e., fluids may pass uphole into plug 10 from the wellbore below plug 10).

In some embodiments, the at least one plug 10 may be launched from surface and driven downhole hydraulically, or via any other suitable means known in the art. During deployment, the outer diameter of plug 10, i.e., the outer diameter of fins 14, 16 may be optimized to sealingly engage with and 'wipe' the inner surface of the casing string, effectively isolating the wellbore therebelow similar to conventional CDPs. In this manner, the outer diameter of plug 10 may be specifically configured to constantly or near-constantly engage the inner surface of the casing string, creating a substantially sealed engagement sufficient to withstand pressure differentials required to displace the plug 10 through the casing (e.g., less than approximately 10 psi). In some embodiments, the outer diameter of plug 10 may be sized and shaped such that, when installed into the casing string, a 'light-squeeze' (frictional engagement) may be imparted upon plug 10, reducing the installation force of the plug 10 into the surface equipment. In some embodiments, the outer diameter of plug 10 may be sized and shaped such that, when pumped through the casing string, a small fluid 'leak' passes through plug 10.

According to embodiments, the at least one plug 10, including annular fins 14,16, may be manufactured, in whole or in part, from any suitable drillable materials. In some embodiments, plug 10 may be manufactured from nitrile rubber, Viton rubber, or polyurethane elastomer. In other embodiments, plug 10 may be manufactured from a polylactic (PLA) material. As would be appreciated, PLA is commercially available in various suitable configurations including, without limitation, PLA+, PLA Flex, and PLA. Advantageously, PLA is known to degrade and weaken at certain temperatures, i.e., above approximately 60° C., rendering the material even more suitable for being drilled out of the wellbore.

According to embodiments, having regard to FIG. 3, plug body 12 may comprise a singular tubular, having a sidewall and forming a longitudinal bore 19. At its downhole end 11, body 12 may be configured to receive at least one solid or near-solid nose cap 17 (see also FIG. 7). Nose 17 may be manufactured, in whole or in part, from any suitable drillable materials as otherwise described herein. In some embodiments, nose cap 17 may be integrally formed with body 12. In other embodiments, nose cap 17 may be configured to be threadably engaged with body 12, via box and pin joint, or via any other suitable connection means known in the art.

In some embodiments, nose cap 17 may advantageously be configured to securely land and rotationally lock plug 10 into downhole equipment positioned within the casing string, e.g., a float collar. For example, without limitation, nose cap 17 may be configured to form a 'flower' shaped tip, a cylindrical 'cork' shaped tip, or any other suitably shaped tip for sealingly corresponding with the shoe track, operable to both sealingly engage and to rotationally lock the plug into the downhole equipment, e.g., float collar. In this manner, once landed, nose cap 17 of plug 10 may serve to hold "bump" test pressure, without reliance upon annular fins 14,16.

In some embodiments, at its uphole end 13, body 12 may also be configured to receive at least one solid or near-solid tail end cap (not shown) for preventing fluid flow through bore 19. Tail end cap may be manufactured, in whole or in part, from any suitable drillable materials as otherwise described herein. In some embodiments, tail end cap may be integrally formed with body 12. In other embodiments, tail end cap 17 may be configured to be threadably engaged with body 12, via box and pin joint, or via any other suitable connection means known in the art.

According to embodiments, as outlined above, the at least one plug 10 may comprise at least one downhole annular wiper fin 14, and at least one uphole annular wiper fin 16. In some embodiments, both or either annular fins 14,16 may be manufactured from any suitable resilient material or composite material capable of sealingly engaging the inner surface of the casing string as plug 10 is pumped downhole, enabling operation of plug 10 as a cement plug and isolating the wellbore therebelow.

In some embodiments, both or either annular fins 14,16 may be manufactured, in whole or in part, from any suitable flexible, drillable materials as otherwise described herein. As will described, it is contemplated that, depending upon use of plug 10, one or both annular fins 14, 16 may be manufactured from different materials so as to optimize their use, e.g., where one fin 14 may be optimized for sealing, while the other fin 16 may be optimized for scraping, centralizing, or to reduce contact friction, and vice versa.

In some embodiments, as above, the at least one plug 10 may be configured to form annular space 15 between at least two annular fins 14, 16. Annular space 15 may extend about sidewall of body 12 and may, via apertures 18 formed in body 12 and extending between fins 14,16 (see FIG. 4), be in fluid communication with the wellbore uphole of plug 10. For example, fluids introduced into the casing string above the plug 10 may enter central housing bore 19 and pass through apertures 18 to fill annular space 15. In this manner, advantageously, an operator desiring to mill the plug 10 from the casing string may introduce additional cement and/or cementing fluids into central bore 19 and into annular space 15, where such fluids will cure, bonding the plug 10 to the inner surface of the casing string.

As will be described, it should be appreciated that fluids may also enter annular space 15 via at least one gap 26 formed in the at least one annular fins 14, 16, causing torsional squeeze of fins 14,16 and anchoring of plug 10 within the casing string. In alternative embodiments, as above, annular space 15 may also be in fluid communication with the wellbore downhole of plug 10.

According to embodiments, as outlined above, the at least one annular fin(s) 14,16 may comprise an integral, unitary annular wiper element extending from body 12, the unitary wiper element being divided into segments by at least one radially extending gap 26. In other embodiments, some or all of the at least one fin(s) 14,16 may be formed from a plurality of segmented fin elements 20 in operable interlocking connection one with another to create a complete annular fin 14,16, the segmented wiper elements 20 forming at least one radially extending gap 26. In either embodiment, advantageously, segments 20 formed by gaps 26 may be configured to readily break apart one from the other wherein, during milling operations, segments 20 readily fragment resulting in full and complete destruction of plug 10 without the creation of annular rings. Moreover, advantageously, plug 10 may be specifically designed to form segments 20 having a predetermined size and shape selected to optimize circulation of the fragments from the casing string. Also in either embodiment, as shown in FIG. 1, the at least one fin(s) 14, 16 may be manufactured so as to be substantially hollow. For example, without limitation, annular fin(s) 14, 16 may form cavities 28 therein, cavities 28 resulting in less material to be milled, enabling a smaller mill to be used and mitigating the creation of annular (toroid shape) rings.

According to embodiments, as above, fin segments 20 may be operably connected to plug body 12 to form annular fins 14,16 extending therefrom (i.e., such that fins 14,16 protrude radially from body 12 to contact and frictionally engage the inner surface of the casing string). In some embodiments, the plurality of fin segments 20 may be releasably mounted to body 12 of plug 10.

Figure 5:
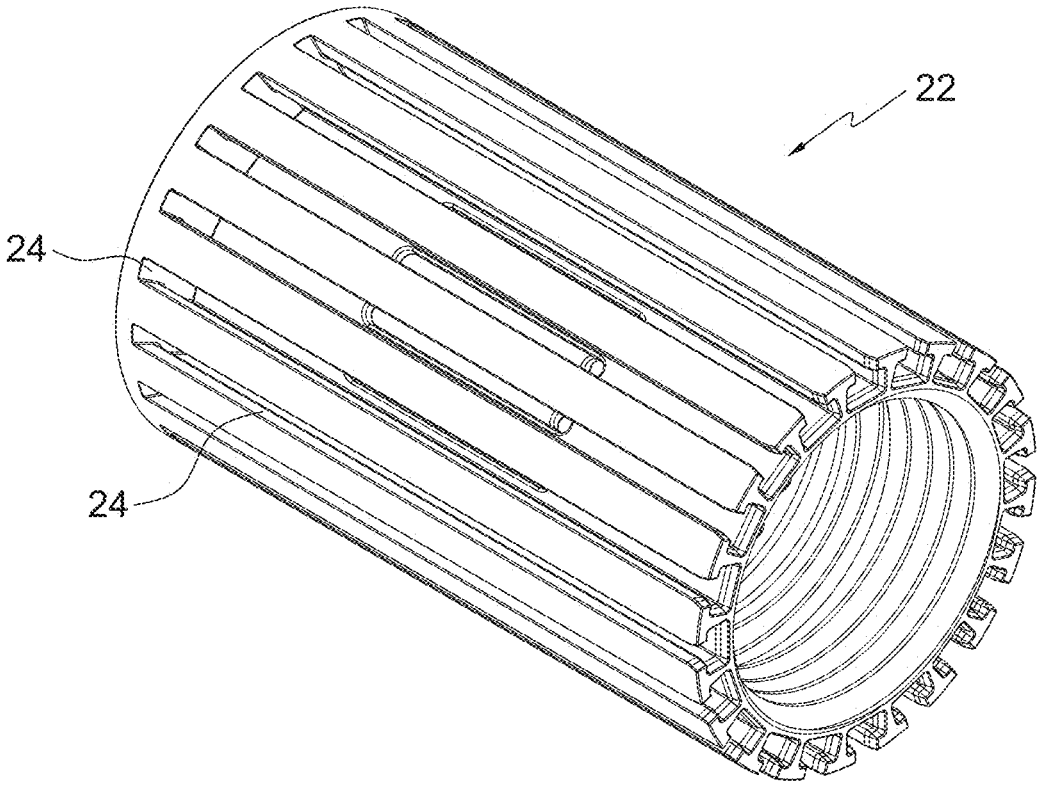
FIG. 5 shows a perspective side view of the inner fin segment guide core of the cement plug shown in FIG. 1, the inner core shown in isolation, according to embodiments.
Figure 6A:
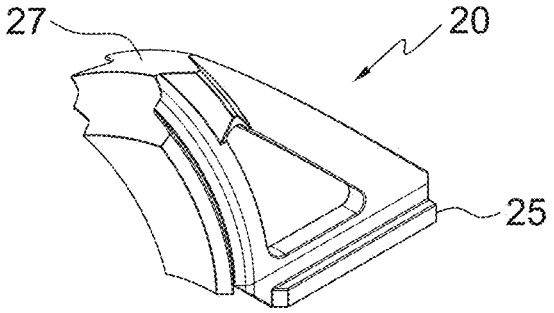
FIG. 6A shows a perspective side rear view of an independent fin segment of the cement plug shown in FIG. 1, according to embodiments.
Figure 6B:
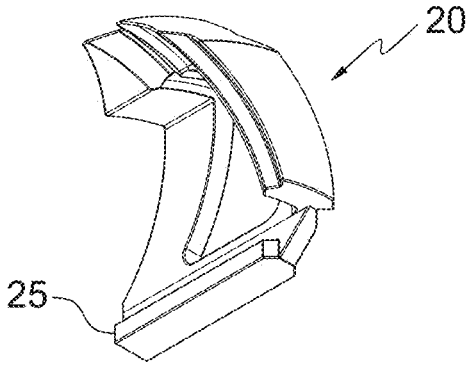
FIG. 6B shows a perspective side front view of the fin segment shown in FIG. 1, according to embodiments.
Figure 6C:
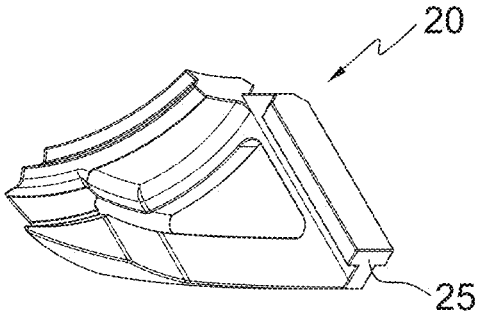
FIG. 6C shows a perspective bottom front view of the fin segment shown in FIG. 1, according to embodiments.
Figure 6D:
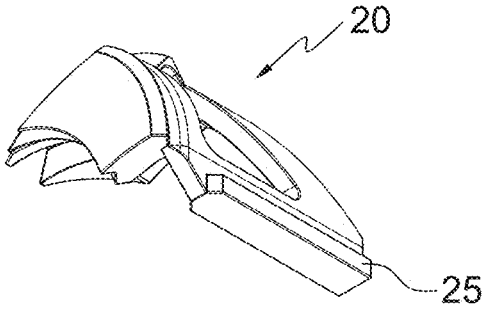
FIG. 6D shows a perspective bottom view of the fin segment shown in FIG. 1, according to embodiments.
Figure 6E:
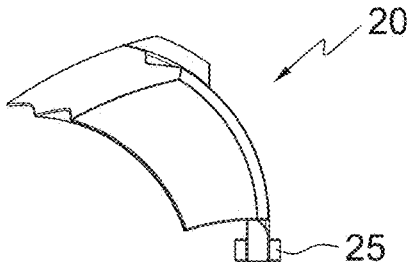
FIG. 6E shows a rear view of the fin segment shown in FIG. 1, according to embodiments.
Figure 6F:
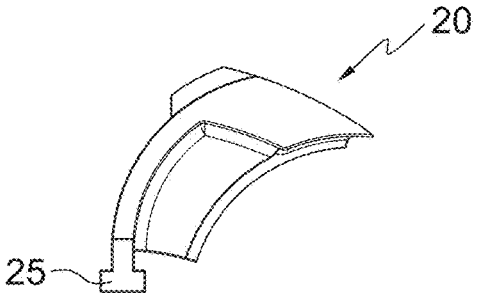
FIG. 6F shows a front view of the fin segment shown in FIG. 1, according to embodiments.
Figure 6G:
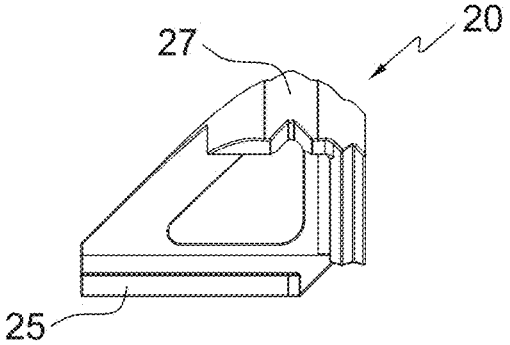
FIG. 6G shows a first side view of the fin segment shown in FIG. 1, according to embodiments.
Figure 6H:
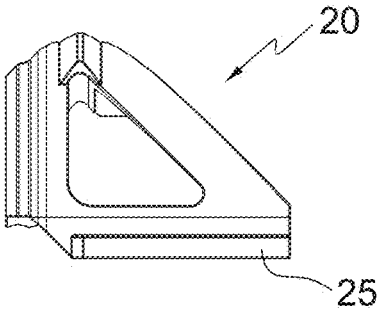
FIG. 6H shows a second side view of the fin segment shown in FIG. 1, according to embodiments.
Figure 6I:
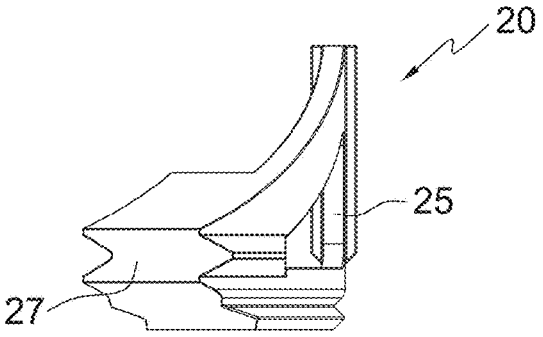
FIG. 6I shows a perspective top view of the fin segment shown in FIG. 1, according to embodiments.
Figure 6J:
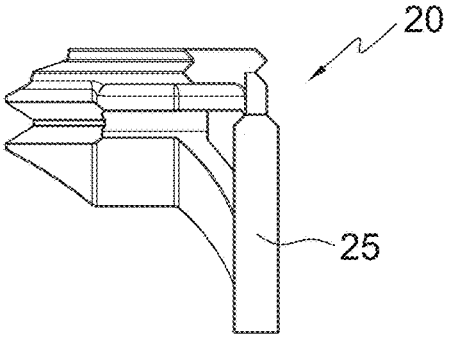
FIG. 6J shows a perspective bottom view of the fin segment shown in FIG. 1, according to embodiments.
Figure 7:
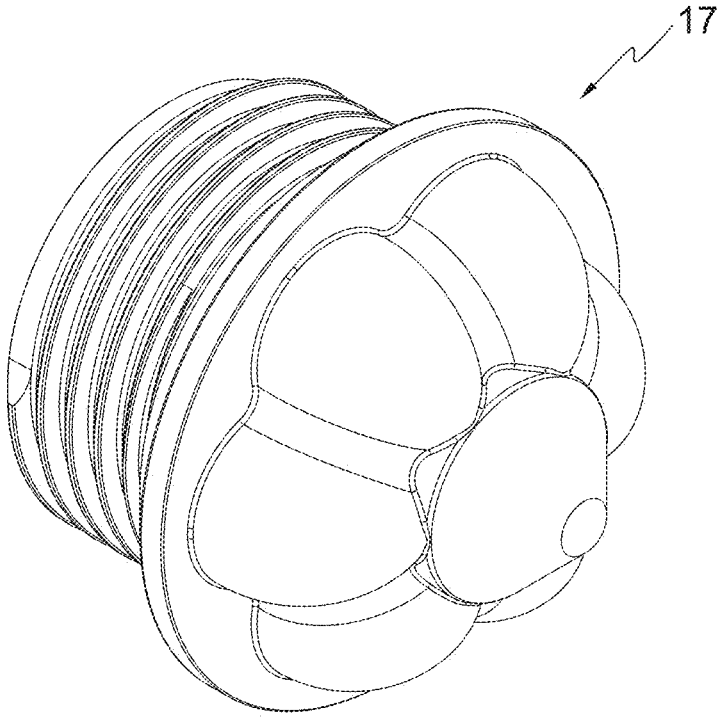
FIG. 7 shows a perspective view of a nose element of the cement plug shown in FIG. 1, according to embodiments.

For example, having regard to FIGS. 3 and 5, in some embodiments, body 12 may comprise at least one inner tubular core 22, concentrically positioned within body 12, and forming a substantially cylindrical sidewall 21. Core 22 may be configured to be slidably received within central housing bore 19. In some embodiments, inner surface of body 12 may form inwardly depending protrusions 23 (FIG. 4) for correspondingly engaging outwardly extending guide slots 24 of core, interlocking body 12 and core 22 to prevent movement or rotation of one relative to the other.

In some embodiments, having regard to FIG. 5, outer sidewall 21 of core 22 may be configured to form a plurality of longitudinally extending segment guide slots 24. As above, slots 24 are configured to correspondingly engage protrusions 23 of body 12, preventing movement therebetween (e.g., serving as a lock and key fit between body tubular 12 and core tubular 22). In this manner, body 12 shown in FIG. 4 may serve as a spacer positioned along outer sidewall of core 22 and between releasably positioned annular fins 14,16, serving to secure fins 14,16 in place.

In some embodiments, slots 24 may be further configured for receiving and retaining at least one fin segment 20 therein, releasably securing fin segment 20 to plug 10. For example, for explanation purposes only, slots 24 may comprise a T-shaped guide extending longitudinally along core 22. Fin segments 20 configured to be slidingly engaged within slots 24, and may be positioned to enable interlocking between adjacent segments 20, forming a complete annular fin 14,16. In some embodiments, having regard to FIGS. 6A-6J and for explanation purposes only, fin segments 20 may be configured to provide a corresponding T-shaped fin groove 25 for corresponding engaging guide slots 24. In this manner, during assembly, groove 25 of each fin segment 20 may be slidably positioned within guide slot 24 of core 22 to retain fin segment 20 in position about body 12.

Although segments 20 are described as independent interlocking elements, it is contemplated that any one of the independent segments may be manufactured so as to be integral with each other, to be integral with tubular core 22, or any combination thereof. It is contemplated that any one of independent segments 20 may be manufactured using any suitable technique known in the industry, including additive manufacturing and/or 3D printing.

In some embodiments, fin segments 20 may be configured to provide a wiper surface 27 extending from segment 20. Wiper surface 27 may be sized and shaped so as to substantially correspond with the inner surface of the casing string, so as to frictionally engage and wipe the surface of the casing string as the plug 10 travels therethrough.

According to embodiments, as above, the at least one fin(s) 14,16 may be configured to form at least gap 26 therethrough (e.g., a perforation or slit extending between and forming segments 20). For example, having regard to FIG. 1, fins 14, 16 may form at least one gap 26 which, for the purpose of explanation only, is shown as formed between each of the plurality of segmented fin elements 20. It should be understood that any size, shape, or configuration of gap 26 extending through fins 14,16 to form segments 20 are contemplated. As above, gaps 26 may be sized, shaped, and positioned so as to allow collapse of fins 14,16 when controllably compressed, for example, when plug 10 may be concentrically positioned within the inner diameter of the casing string, but eccentrically placed relative to the drill bit. Moreover, gaps 26 may be sized and shaped to optimize the overall outer diameter of plug 10 relative to the inner diameter of the casing string. For example, gaps 26 may be configured to allow for a specified volume of space within fins 14,16 that can become reduced when plug 10 is compressed for installation into the casing string, i.e., when a 'light-squeeze' is imposed upon plug 10 during installation into the surface equipment.

According to embodiments, without limitation, gaps 26 may extend radially outwardly from plug body 12 to the inner surface of the casing string. For example, having regard to FIG. 1, gaps 26 may extend from body 12 to the wiping surface 27 of fins 14,16. Depending upon the size of the casing string, the size, shape, and overall configuration of the gaps 26 may be optimized, e.g., such as for use in mono bore applications, effectively minimizing the friction, drag, and wear on plug 10 (e.g., on the plug fins 14, 16). Moreover, having regard to FIG. 3, the internal diameter of the gaps 26 may be the same or smaller than the outer diameter of the drill bit used to mill the plug. For example, as shown for explanatory purposes only, the outer diameter of the drill bit 30 may be at least the same size or larger than the internal diameter of the gaps 26 (or the circumference of the body 12). For example, where the size of the drill bit used to mill CPDs from casing string are conventionally the size of the drift diameter of the casing, the presently improved CDP enables the use of an undersized drill bit (e.g., approximately ½ inch or ¾ inch smaller than the drift diameter of the casing). It will be appreciated that the use of a smaller drill bit (e.g., the use of a production casing bit) to mill a CDP eliminates the need for an entire trip of drill equipment, saving significant time and costs.

In further embodiments, gaps 26 formed in fins 14,16 may also be configured to optimize to maintain contact pressure between plug 10 and the inner surface of the casing string, while managing pressure differentials imparted plug 10 as it travels through the string. For example, gaps 26 may be configured to create a specific tortious fluid flow path through the independent segments of fin 14, 16, causing the tortious collapse or axial displacement of fins 14, 16 against itself, causing radial squeeze outwardly against the casing. In this manner, depending upon the size of the casing string, the size, shape, and overall geometry of gaps 26 may be optimized to control the volume of fluid flow therethrough, ensuring plug 10 undergoes a constant or near-constant squeeze from the casing string, minimizing leakage through plug 10 during cementing operations. The size, shape, and overall geometry of gaps 26 may also be optimized to ensure fins 14,16 provides sufficient mechanical strength to withstand fluid pressure differentials imposed on fins 14, 16, as plug 10 travels through the casing string. In this manner, a single nose element 17 (e.g., sealing fin) may be used without wearing out before it arrives at downhole equipment, such as the float collar. That is, the high differential pressure across plug 10 to withstand 'bump' pressure is primarily taken by nose element 17, eliminating the high-pressure requirements from fins 14, 16. Moreover, the smaller sealing area of nose 17, relative to the inner diameter of the casing string, allows plug 10 to be manufactured from drillable materials that mill up quickly with low torque, are inexpensive, and can be readily manufactured as independent parts.

According to embodiments, without limitation, the presently improved cement plug 10 may be optimized for use in one size and one weight of casing string, such as in mono bore completions typical of the surface and intermediate strings, and when the shoe track is milled out with a drill bit having a relatively small outer diameter. It is an object that the presently improved cement plug 10 be readily milled out by breaking into pre-sized segments, eliminating the creation of annular rings (e.g., toroid shape), milling debris, and the like. As a result, plug 10 and resulting fragments may be effectively circulated to surface along with cuttings and wellbore fluids. Fluid flow through gaps 26 in fins 14, 16 may be controllably reduced/compressed to ensure that plug 10 effectively isolates the cement from displacement fluids during cementing operations, without the creation of an atmospheric chamber therebetween (i.e., within annular space 15).

According to embodiments, methods of using the presently improved plug 10 are provided, such methods comprising providing at least one cement plug 10 having a first end 11 and a second end 13, and at least one wiper fin disposed about a sidewall of the at least one plug 10. In some embodiments, plug 10 may comprise at least two annular wiper fins 14,16, such fins 14,16 forming an annular space 15 therebetween. In some embodiments, at least one of the at least two wiper fins 14,16 may form at least one gap 26 therethrough, gaps 26 extending radially outwardly from plug body 12 to the inner surface of the casing string and forming at least one fin segment 20.

In some embodiments, the methods further comprises launching the at least one cement plug 10 into the casing string, introducing fluids into the casing string to hydraulically pump the plug 10 through the casing string, and allowing the at least one annular fin to frictionally engage with and wipe the inner surface of the casing string as the at least one plug 10 travels through the casing string.

In some embodiments, the method further comprises securing the at least one plug 10 within the casing string by positioning the at least one plug 10 within the casing string, introducing cement into the casing string, and allowing the cement to pass into central bore 19 and annular space 15, torsionally anchoring the at least one fin(s) 14,16 and securing the at least one plug 10 in position within the casing string. In some embodiments, the positioning of the at least one plug 10 comprises landing and rotationally locking the at least one plug 10 in equipment positioned within the casing string, e.g., a float collar. In some embodiments, once the at least one plug 10 is landed, the method further comprises performing a pressure test of the casing string (e.g., 'bump' pressure).

In some embodiments, the present methods may further comprise providing drilling equipment into the casing string, and drilling the at least one plug 10 from the casing string to reinstate fluid flow therethrough. In some embodiments, the drilling equipment may comprise an undersized drill bit, i.e., a drill bit having an outer diameter 30 at least the same size or larger than the inner diameter of the core 22 of body 12 (and gaps 26 extending radially outwardly therefrom).

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and the described portions thereof.

I claim:

1. A cement plug for use in wiping the inner surface of a casing string positioned within a subterranean wellbore, the plug comprising:

a tubular body having a first end and a second end and a cylindrical sidewall forming a longitudinal bore, at least one annular wiper fin extending radially from the body, the at least one wiper fin forming at least one gap extending through the at least one wiper fin and dividing the at least one wiper fin into segmented fin elements configured to break apart one from the other during drilling of the cement plugs.

2. The plug of claim 1, wherein the cement plug comprises at least two annular wiper fins positioned axially along the tubular body, the at least two wiper fins forming an annular space therebetween.

3. The plug of claim 2, wherein one of the at least two annular wiper fins is positioned at the first end of the body, and another one of the at least two wiper fins is positioned at the second end of the body.

4. The plug of claim 2, wherein at least one of the at least two wiper fins comprises a unitary annular fin.

5. The plug of claim 2, wherein at least one of the at least two wiper fins comprises a plurality of interlocking fin segments.

6. The plug of claim 2, wherein at least one of the at least two wiper fins are hollow.

7. The plug of claim 1, wherein the at least one gap extends from the body to an outer surface of the at least one wiper fin.

8. The plug of claim 1, wherein the tubular body further comprises a plurality of longitudinally extending apertures allowing fluid flow from the longitudinal bore of the body to the at least one annular space.

9. The plug of claim 1, wherein the plug further comprises at least one first cap positioned at the first end of the body, securely received within the longitudinal central bore and preventing fluid flow therethrough.

10. The plug of claim 9, wherein the at least one first cap positioned is configured for sealingly landing and locking the at least one plug within equipment positioned within the casing string.

11. The plug of claim 1, wherein the plug further comprises at least one second cap positioned at the second end of the body, securely received within the longitudinal central bore and preventing fluid flow therethrough.

12. A method of wiping an inner surface of a casing string positioned within a subterranean wellbore, the method comprising:

providing at least one cement plug having a first end and a second end, and at least one annular wiper fin disposed about a sidewall of the at least one cement plug and extending radially outwardly therefrom to the inner surface of the casing string, the at least one annular wiper fin forming at least one gap extending through the at least one wiper fin and dividing the at least one wiper fin into segmented fin elements configured to break apart one from the other during drilling of the cement plug, launching the at least one cement plug into the casing string, introducing fluids into the casing string to hydraulically pump the at least one cement plug through the casing string, and allowing the at least one segmented annular wiper fin to frictionally engage with and wipe the inner surface of the casing string as the at least one plug travels through the casing string.

13. The method of claim 12, wherein the at least one cement plug has at least two annular wiper fins positioned axially along the plug and forming an annular space therebetween, and the method further comprises securing the at least one cement plug within the casing string by positioning the at least one cement plug within the casing string, introducing cement into the casing string, and allowing the cement to pass through the at least one cement plug into the annular space, torsionally anchoring the at least one cement plug in the casing string.

14. The method of claim 13, wherein the positioning of the at least one cement plug comprises landing and rotationally locking the at least one cement plug in equipment positioned within the casing string.

15. The method of claim 14, wherein, once landed within the casing string, the method further comprises performing a pressure test of the casing string.

16. The method of claim 12, wherein the method further comprises providing drilling equipment into the casing string, and drilling the at least one cement plug from the casing string to reinstate fluid flow therethrough.

17. The method of claim 16, wherein the drilling equipment comprises an undersized drill bit.

18. The method of 12, wherein the segmented fin elements comprises a plurality of interlocking fin segments.

19. The method of claim 18, wherein, during the drilling of the at least one cement plug, the plurality of interlocking fin segments disconnect from one another.

20. The method of claim 19, wherein the method comprises circulating the at least one plug from the casing string.

* * * * *